United States Patent [19]

Holik

[11] Patent Number: 4,714,522

[45] Date of Patent: Dec. 22, 1987

[54] DEVICE FOR DECELERATING FAST-FLOW CURRENTS OF WHITE WATER

[75] Inventor: Herbert Holik, Ravensburg, Fed. Rep. of Germany

[73] Assignee: Sulzer-Escher Wyss GmbH, Ravensburg, Fed. Rep. of Germany

[21] Appl. No.: 888,363

[22] Filed: Jul. 23, 1986

[30] Foreign Application Priority Data

Jul. 30, 1985 [CH] Switzerland ..... 03300/85

[51] Int. Cl.[4] ..... D21F 1/68

[52] U.S. Cl. ..... 162/264; 138/26; 138/37; 138/39; 162/190; 162/DIG. 7

[58] Field of Search ..... 162/264, 190, 380, DIG. 7; 138/26, 37, 39, 41; 406/171; 209/273

[56] References Cited

U.S. PATENT DOCUMENTS

| | | | |
|---|---|---|---|
| 3,692,183 | 9/1972 | Tra | 209/273 |
| 3,960,653 | 6/1976 | Futcher et al. | 162/264 |
| 4,028,174 | 6/1977 | Myren | 162/264 |
| 4,116,259 | 9/1978 | Koskimies et al. | 162/380 |
| 4,213,823 | 7/1980 | Wittig et al. | 162/380 |

*Primary Examiner*—Kenneth M. Schor
*Assistant Examiner*—K. M. Hastings
*Attorney, Agent, or Firm*—Robert A. Ostmann

[57] ABSTRACT

White water at a high speed of current occurs in the region of a forming roll in a paper machine running at a high speed. The white water is caught in a white water trough which is provided with deflection vanes and is carried substantially at the initial speed by means of a duct (1) out of the ground plan of the paper machine to a stilling tower (2) standing adjacent to the paper machine, to feed the inner wall of a screen wall (3) of a screen cage, which wall is arranged in the stilling tower. The wall (3) is curved and has openings (4) for the white water to pass through. They are designed to peel off in layers the film of white water which is sent along the wall (3) and to deflect the jets of white water passing through the openings (4) radially outwards to the wall (3) against an outer wall (5) of the stilling tower (2), where the actual deceleration of the current takes place in several individual jets.

9 Claims, 12 Drawing Figures

DEVICE FOR DECELERATING FAST-FLOW CURRENTS OF WHITE WATER

FIELD OF THE INVENTION

This invention relates to a device for decelerating fast-flowing or blasting currents of white water on a paper machine running at high speed, which current is channelled in a white water trough at the point of generation in the region of a forming roll of the paper machine at a high speed of generation.

BACKGROUND OF THE INVENTION

At the forming roll of a fast-running paper machine, e.g. a tissue machine, a very large quantity of water is thrown off at machine speed, which today may be as high as 60, 90 to 120 km/h. The white water must be removed from the paper machine and also the current energy must be reduced.

PRIOR ART

Today, two different principles are applied safely to bring the white water out of the paper machine and to decelerate it.

In one principle, the white water spraying off from the forming roll is slowed down in the paper machine and is slowly removed from the paper machine. This has the disadvantage that the water has to be accelerated again in order to bring it out of the machine. Ducts of large cross-section are necessary for this, because the speed of the current is low. The deceleration device within the machine has the further disadvantage that it is difficult to gain access to it, when for example it is to be cleaned.

In the second principle, the white water is removed from the paper machine as quickly as possible at the speed imparted to the forming roll, and is decelerated outside the machine. This has the advantage that it is certain that no accumulation of water occurs in the paper machine, the cross-sections of ducts for the current are small and self-cleaning. Present systems of this type, however, have the disadvantage that the current forces are only broken incompletely, and a large amount of air is drawn into the current and consequently breakdowns may occur in the white water circuit.

SUMMARY OF THE INVENTION

It is an object of the invention to provide a device for the removal of blasting currents of white water, by which a gentle deceleration of the current takes place, after the white water which has been removed at high speed out of a paper machine, in order to be certain to prevent a back build-up in the paper machine.

According to the present invention there is provided a device for decelerating a fast-flowing current of white water on a paper machine running at high speed, which current is channelled at the place of generation in the region of a forming roll of the paper machine at a high speed of generation into a white water trough, wherein a duct is provided for guiding the current substantially at the speed of generation out of the ground plan of the paper machine to a stilling tower which stands adjacent to the paper machine, and which contains a screen cage having an inner curved wall formed with openings for the white water to pass through, and wherein the duct is arranged to direct the white water to flow along the inner curved wall of the screen cage and the openings in the cage are designed to peel off in layers the current sent along the wall and to deflect the jets of white water passing through the openings radially outwards of the wall of the screen cage against the inner wall of the stilling tower, where the actual deceleration of the current takes place in several individual jets.

With the present device, the deceleration should preferably take place without an excessive intake of air into the white water and on the contrary, even the air which is already present in the white water should desirably be removed therefrom. The device may be made adaptable to various operating conditions, and may be simpler in terms of construction than the previous solutions. During construction of a preferred embodiment it is not necessary to go beneath the level of the machine base. Thereby, the device is intended to save space and also to be usable in the case of very unfavourable local conditions.

The gentle deceleration of the current which is aimed for with the present device takes place through the best possible energy dissipation, namely through the division of the current into several individual currrents, which are deflected simultaneously against the inner wall of the surrounding stilling tower for impact. The flow is frequently removed approximately horizontally into a chamber adjacent to the paper machine at high speed, for which reason only small cross-sections of the duct are necessary, so that the solution saves space and the space conditions within the paper machine are not impaired. The speed and extent of the individual currents of white water can be influenced by the radius of the pierced wall and the hole geometry. In addition, it is no longer necessary to go into a space beneath the level of the machine base in guiding the white water to the screen vessel. Because of this, the solution is also very space-saving, as the energy dissipation occurs in the smallest space. The device adapts itself to differing speeds and throughputs of the white water. The device is simple in terms of construction and for this reason represents a saving on costs.

In a preferred embodiment, the duct has a deflection device at the beginning for the current in the paper machine, the deflection device having deflection vanes, which are constructed such that the free spray current coming from the forming roll and also the deflected current always strike these deflection vanes or respectively the wall of the deflection device at an angle of from 15° to 35°, hence experiencing a deflection which is as low in loss as possible in the transverse direction to the paper machine.

DETAILED DESCRIPTION OF THE DRAWINGS

In order to enable the invention to be more readily understood, reference will now be made to the accompanying drawings, which illustrate diagrammatically and by way of example some embodiments thereof, and in which:-

Figure 1:
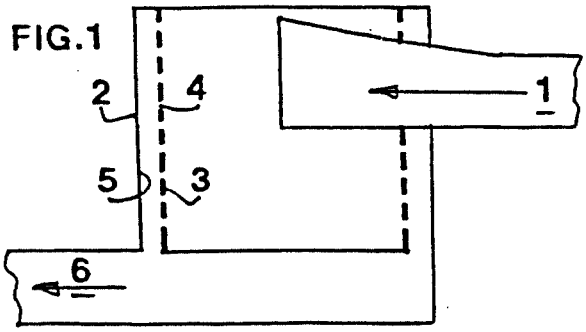
Figure 4:
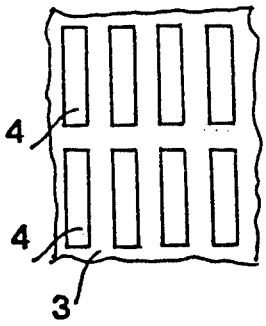
Figure 2:
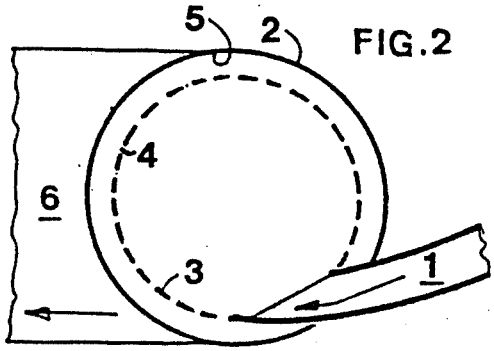
Figure 12:
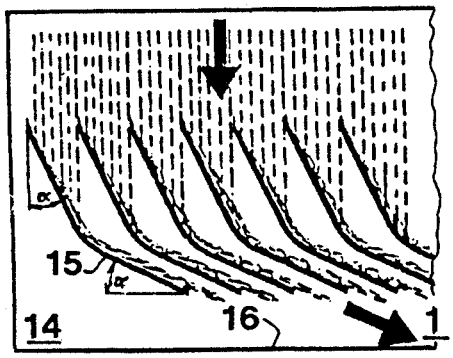
Figure 3:
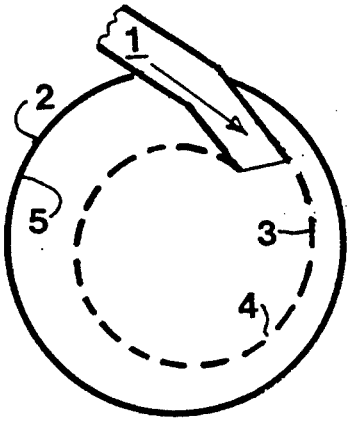
Figure 5:
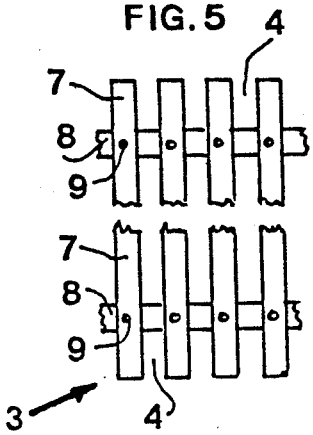
Figure 6:
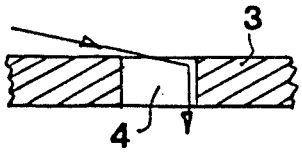
Figure 7:
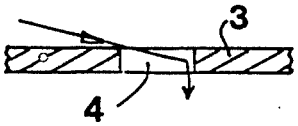

FIG. 1 is a schematic vertical cross-section through a deceleration device in accordance with the invention, FIG. 2 is a horizontal cross-section of the same embodiment as shown in FIG. 1, FIG. 3 is a horizontal cross-section through another embodiment, FIG. 4 is a detail to an enlarged scale of part of a curved wall of the device shown in FIG. 1 developed in the plane of the paper, FIG. 5 is a view similar to FIG. 4 of another embodiment of the curved wall, FIGS. 6, 7, 8, 9, 10 and 11 each shown to an enlarged scale a horizontal cross-section through a different respective embodiment of the curved wall, and FIG. 12 shows a deflection device in a section transverse to the deflection vanes.

White water comes out of the region of a forming roll of a paper machine at a high speed, which is approximately equal to the machine speed, i.e. present day speeds of 60, 90 to 120 km/h. The white water is caught in a white water trough, provided with a deflection device 14 (FIG. 12) at the beginning of a duct 1 (FIGS. 1 and 2). The deflection device comprises a plurality of vanes 15 which are constructed such that the free spray current coming from the forming roll and also the deflected current always strikes against these deflection vanes or respectively against the wall 16 of the white water trough at an angle $\alpha$ which lies between 15° and 35°, hence experiencing a deflection which is as low in loss as possible in transverse direction to the paper machine. The white water is further guided through the duct 1 to a stilling tower 2 which contains a screen cage in the form of a curved wall 3 which has openings 4 for the white water to pass through. The white water is fed into the stilling tower substantially tangential to the inside of the curved wall 3. The openings 4 are intended to allow layers of the current which flows along the wall 3 to peel off so that the white water jets passing through the openings 4 are deflected, radially to the wall 3, outwardly against the inner wall 5 of the stilling tower 2, where the actual deceleration of the current takes place. This stilling tower stands adjacent to the paper machine on the level of the machine base. The white water striking against the wall 5 of the stilling tower flows along the wall 5 downwardly into a channel 6 towards the screen vessel.

As can be seen in particular in FIG. 2, the curved wall 3 is circular in plan view, so that the screen cage is a cylindrical body, which stands vertically in the tower as can be seen particularly well in FIG. 1. However, it is conceivable, that the screen cage could also be arranged horizontally or inclined.

According to another embodiment, which is shown in FIG. 3, the curved wall 3 may be spiral in shape, viewed in plan view. This arrangement makes it possible to adjust the speed and quantity of the individual currents through the holes 4, by varying the radius of the spiral and/or the geometry of the through holes 4. The wall 5 of the stilling tower 2 is cylindrical and stands on the level of the machine base. It surrounds the curved wall 3. The curved wall 3 is arranged inside the wall 5 of the stilling tower 2, substantially concentrically therewith, and at a distance from the base of the stilling tower. The duct 1 for the white water opens out tangentially to the inner side of the curved wall 3 in order to form a film of water along the wall. The opening cross-section of the duct 1 in the axial direction of the screen cage is greater than in the radial direction. The change in cross-section is intended to ensure that the film of water sweeps over the inner wall of the curved wall 3 over a large area. This is shown in particular in FIG. 1. In order to guarantee that the film of water flows on the inner wall of the curved wall 3, and lies against it, the duct 1 is deflected in the horizontal direction through approximately 25° or along a constant curve of the duct before the duct enters into the screen cage. This is shown in particular in FIGS. 2 and 3.

The openings 4 in the screen cage may have differing geometries.

As is shown in the embodiment of FIG. 4, the openings 4 are rectangular, their longer sides running in axial direction of the screen cage, and the openings are arranged in rows. In this way, the longer edges of the respective openings always lie transverse to the current flowing tangentially along the inner wall 3. This is shown for example in FIGS. 6 or 7. However, the longer side of the rectangle may also lie in the circumferential direction of the screen cage, which depends upon the size of the openings, the cage radius and the peel surface dimension. Even round openings are conceivable. The white water flows tangentially to the curve of the wall 3, so that a layer of the film of water is branched there in layers and strikes against the wall of the opening which points radially outward, whereby the jet is deflected. On impingement onto the wall 5, the actual deceleration of the current, which is divided into individual streams, takes place.

Figure 11:
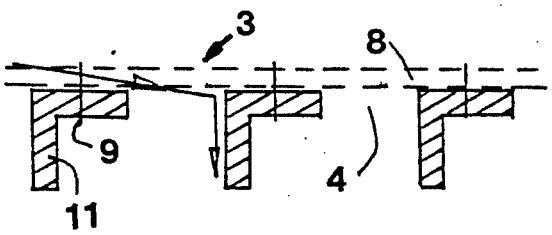

As shown in the embodiment of FIGS. 5, it is possible to form the curved wall 3 from individual bars 7 running axially to the screen cage, the individual bars 7 being attached to hoops 8 with rivets 9. Other forms of embodiment of the curved wall 3, composed of individual bars, are shown in detail in FIGS. 10 and 11. Whereas the bars 7 in FIG. 5 have a rectangular cross-section, the bars 10 shown in FIG. 10 have an irregular cross-section, so that the edge opposed to the direction of current of the water jet is higher than the edge of the previous bar in the direction of current. The curved wall according to FIG. 11 is composed of L-section bars 11.

Figure 9:
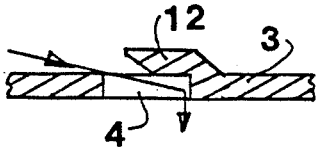
Figure 10:
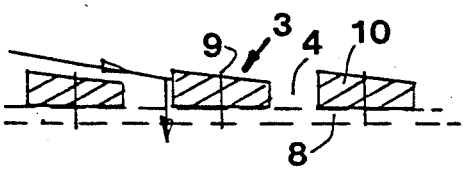

As shown in particular in FIG. 9, the openings 4 may be provided with peeling mechanisms 12 in the form of a peeling blade of a peeling knife, to peel off a layer of white water in the direction through the opening 4 and against the outer wall of the stilling tower.

The screen cage, which is formed by means of the curved wall 3, and which usually stands vertically in the space, is covered at the top and bottom with a half cover in which round openings are formed centrally. The upper half cover is to prevent the white water spraying out into the surrounding area of the stilling tower. The opening of the lower half cover is intended for emergency for the white water to pass through out of the space of the screen cage. Normally, all the white water flows through the holes 4 of the curved wall 3, impinges against the wall 5 and flows downward along the latter.

The current of white water which is to be decelerated is a two-phase current, which is introduced into the screen cage of the stilling tower at its full speed, predetermined by the speed of the paper machine, and with the energy resulting therefrom. The two phases of the current are water and air, the water being present predominantly as water drops. In addition to the deceleration of this current, it is also an object of the device to remove air from the flow of the white water. This occurs in that the current flows through the curved duct 1 described above, in a horizontal direction, so that the current flows along the wall of the duct 1, but principally against the curved wall 3 of the screen cage under the effect of centrifugal force. By this means, the separation of the two phases from each other comes about, so that on the curved wall a film of water forms, which releases the air bubbles through a centrifugal effect. The film of water is peeled off in layers at the openings 4 and is divided into individual jets. Any air bubbles which may still be present in the jets are separated out of the water on impact of the jet on the wall 5.

This is the additional effect of the dissipation of the current into the small individual jets, which are guided through the openings 4. As the steadied white water is intensively evacuated of air after the screen cage, further steps, necessary hitherto, for the removal of air from the white water flow are not required, or are on a considerably smaller scale. The earlier long air evacuation channels are therefore no longer applicable, which means a considerable advantage in terms of structural engineering, because the air evacuation channels which were previously necessary had to be 20 metres long and more, in order to achieve the removal of air from the white water on its way to the white water tower. As, after stilling, the white water flows downward vertically along the wall 5 of the stilling tower, no eddies occur beneath the screen cage on transition into the connection channel 6. In previously proposed devices eddies actually formed here which sucked additional air into the white water. Current brakes are also no longer applicable, such as brake crosses which had to be provided to prevent the formation of eddies.

Therefore, it is also important that the openings 4 in the curved wall 3 are constructed such that when the white water passes through them, the resulting jets of the white water are deflected, so that they strike the wall 5 perpendicularly and do not flow obliquely to the wall, which would lead to a rotation on this wall 5 and could cause the formation of eddies in the transition to the connection channel.

If any blockage of the screen cage should occur, it is a great advantage of the device that the stilling tower 2 is arranged with the screen cage outside the paper machine, so that the screen cage is easily accessible for any rinsing through. This rinsing would be very troublesome inside the paper machine and would disturb the functioning of the paper machine.

Figure 8:
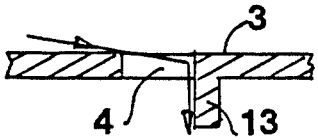

As is shown particularly well in FIGS. 6 to 11, the film of white water moves along the inner wall of the curved wall 3 under the effect of centrifugal force. This means that in the region of an opening 4, the movement of the film continues to follow a tangent to the radius of the curved wall. Thereby, the above mentioned peeling off of a layer of the film is in fact brought about on the edge vertically opposed to the direction of movement of the film. It can also be seen from FIGS. 6 and 7 that to achieve the deflection of the white water jet on passing through the opening 4 in the direction towards the wall 5, a certain thickness of the wall 3 is necessary, namely such that the white water jet does not pass through without being deflected on the wall of the opening 4, which would then lead to the undesired rotation along the wall 5. For reasons of economy, it is a matter of course that attempts are made to construct the curved wall 3 from as thin a sheet as possible. This can also be made possible through the embodiments of the wall 3 in the region of the opening 4, which are shown in FIGS. 8 and 9 respectively. Here, attention is directed to the shape of the projection 13 in FIG. 8, which arises through the pressing through of the material of the wall. Another example of such a curved wall 3, produced from thin sheet metal, is the peeling blade 12 in FIG. 9, which may again be formed by pressing the material on production of the opening 4.

The scope of protection of the device according to the invention for the deceleration of blasting currents of white water is on no account restricted only to the example embodiments which have been shown or described.

What is claimed is:

1. Paper making apparatus comprising a high speed paper making machine having a base and in which is generated a fast-flowing current of white water; a stilling tower having a bounding wall and containing a screen cage spaced radially inward from said wall and including a curved inner wall; duct means at or above the elevation of the base of the paper making machine and in communication with the inside of the screen cage and structured for guiding white water out of said machine and causing it to flow along the curved inner wall of the screen cage at substantially its speed of generation, the screen cage also including through openings which divide white water flowing along its inner wall into a multiplicity of individual jets which are directed radially to impinge upon, and thereby to be decelerated by, said bounding wall, said openings constructed so that the jets strike the bounding wall perpendicularly and do not flow obliquely to the bounding wall; and a channel connected with a lower region of the stilling tower for collecting and discharging white water which descends along the bounding wall following said impingement of the jets upon that wall.

2. The apparatus of claim 1, wherein the curved wall of the screen cage is circular in plan view and the screen cage is a cylindrical body.

3. The apparatus of claim 1, wherein the curved wall of the screen cage is spiral-shaped in plan view.

4. The apparatus of claim 1, wherein the bounding wall of the stilling tower is cylindrical and stands on the level of the machine base, the screen cage being spaced above the base of the stilling tower.

5. The apparatus of claim 2, wherein the duct for the white water opens out tangentially to the inner curved wall of the screen cage to form a film of water along the wall, and wherein the cross-section of the mouth of the duct is greater in the axial direction of the screen cage than in the radial direction, the duct being designed to feed the upper part of the surface of the inner wall over a large area.

6. The apparatus of claim 2, wherein the openings in the screen cage are rectangular and are arranged with their longer edges in the axial direction of the screen cage and transverse to the intended direction of current along the wall.

7. The apparatus of claim 2, wherein the screen cage consists of bars which are attached to hoops in spaced relationship whereby the openings are formed by the spaces between the bars.

8. The apparatus of claim 1, wherein the openings in the screen cage are provided with peeling mechanisms in the form of a peeling blade of a peeling knife, to peel off a layer of white water in the direction through the opening and against the bounding wall of the stilling tower.

9. The apparatus of claim 1 in which the fast flowing current of white water is in the form of a free spray from a forming roll of the paper making machine; and which includes deflection vanes at the entrance of the duct which both intercept the free spray and deliver it to the duct at an angle between 15° and 35°.

* * * * *